US006467460B1

(12) United States Patent
Stier

(10) Patent No.: US 6,467,460 B1
(45) Date of Patent: Oct. 22, 2002

(54) FUEL INJECTION VALVE

(75) Inventor: Hubert Stier, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,824

(22) PCT Filed: Mar. 16, 2000

(86) PCT No.: PCT/DE00/00820

§ 371 (c)(1),
(2), (4) Date: Jan. 22, 2001

(87) PCT Pub. No.: WO00/57050

PCT Pub. Date: Sep. 28, 2000

(30) Foreign Application Priority Data

Mar. 20, 1999 (DE) ..... 199 12 665

(51) Int. Cl.[7] ..... F02M 37/04
(52) U.S. Cl. ..... 123/498; 239/102.2
(58) Field of Search ..... 123/498, 467, 123/478, 447; 239/102.2, 88, 533.9; 251/129.06, 129.01, 335.1, 335.2, 335.3

(56) References Cited

U.S. PATENT DOCUMENTS 2,721,100 A * 10/1955 Bodine, Jr. ..... 299/25
4,649,886 A * 3/1987 Igashira et al. ..... 123/498
4,725,002 A * 2/1988 Trachte ..... 239/102.2
4,750,706 A * 6/1988 Schlagmuller ..... 251/129.06
4,838,233 A * 6/1989 Hayashi et al. ..... 123/506
6,253,736 B1 * 7/2001 Crofts et al. ..... 123/498
6,311,950 B1 * 11/2001 Kappel et al. ..... 251/129.06
6,313,568 B1 * 11/2001 Sullivan et al. ..... 310/346

FOREIGN PATENT DOCUMENTS

DE 195 34 445 3/1997
DE 196 53 555 6/1998

* cited by examiner

*Primary Examiner*—Willis R. Wolfe
*Assistant Examiner*—Mahmoud Gimie
(74) *Attorney, Agent, or Firm*—Kenyon & Kenyon

(57) ABSTRACT

A fuel injector, in particular an injector for fuel injection systems of internal combustion engines, has a fuel inlet connection piece for supplying fuel, a piezoelectric or magnetostrictive actuator which is sealed with respect to the fuel by a seal, and a valve closing body actuatable by the actuator via a valve needle, the valve closing body working together with a valve seat surface to form a seal seat. The seal includes a gasket sheet which is arranged between the fuel inlet connection piece and the actuator, and has a fuel channel for directing the fuel from the fuel inlet connection piece toward the seal seat.

22 Claims, 2 Drawing Sheets

FUEL INJECTION VALVE

FIELD OF THE INVENTION

The present invention relates to a fuel injector.

BACKGROUND INFORMATION

German Patent No. 195 34 445 describes a fuel injector having a valve body in which a valve needle is coaxially guided. The valve body has a connection piece through which fuel is supplied to the fuel injector. The valve needle is provided with a central borehole. On the outside the valve needle is sealed with respect to the surrounding valve body. In order to actuate the valve needle, the latter is provided on the inlet side with a pressure shoulder, which works together with a piezoelectric actuator. The pressure shoulder is permanently connected to the valve needle and is guided tight on the valve body on the inlet side. This protects the actuator against the effect of the fuel pressure.

A disadvantage of this known fuel injector is that the pressure shoulder is movably guided in the valve body in order to allow the fuel to be injected, forming at the same time a sealing surface with the valve body to protect the actuator against the very high fuel pressure. The valve needle is sealingly and movably guided in the valve body also on the injection side, resulting in a number of disadvantages.

Because the valve needle is permanently connected to the pressure shoulder, the valve needle on the injection side and the pressure shoulder on the inlet side are sealingly and movably guided in the valve body, manufacturing is relatively complicated and the valve needle of the fuel injector is subject to bending and stresses and the relative positions of the two sliding surfaces subject are to being modified.

Because the pressure shoulder, i.e., the valve needle is movably guided with respect to the valve body, the sealing surface is wetted with fuel and, due to the high fuel pressure, the fuel may flow toward the actuator. Thus, the actuator is only protected against the effect of the fuel pressure but not against the effect of the fuel.

Due to the seal between the pressure shoulder, i.e., the valve needle and valve body, friction losses occur when the fuel injector is actuated. This negatively affects the shapability of the fuel injection, the switching times of the injector are increased, the actuator power is less efficiently utilized and fuel injector wear is increased. In particular, the seal at the sealing surfaces between the pressure shoulder, i.e., the valve needle and the valve body deteriorates during operation.

SUMMARY OF THE INVENTION

The fuel injector according to the present invention has an advantage of a simple, more cost-effective, low-wear, friction-free and considerably more compact design. Furthermore, according to the present invention, the seal is independent of the design of the valve needle and can therefore be integrated into a plurality of fuel injectors.

The gasket sheet is a circular gasket sheet and therefore can be particularly easily inserted into a fuel injector without a central hole having a round radial cross-section.

The gasket sheet has at least one recessed, radial flow-through segment formed by a cutout, to conduct the fuel. Thus part of the fuel line is integrated in the gasket sheet, whereby fewer components are needed, resulting in a more compact design of the fuel injector.

The gasket sheet has a baseplate and a spacer, the baseplate having a cylindrical design and the spacer having at least one radial cutout, or recess the fuel channel being formed by the cutout. The baseplate, which is inexpensive due to its simple design, can therefore be installed in the fuel injector independently of the other components of the gasket sheet. Another advantage is that, due to the separate installation of the spacer, the radial direction of the fuel channels can be selected independently of the other components of the gasket sheet, which simplifies the adjustment of the direction of the fuel channels in particular.

The gasket sheet has at least one borehole through which at least one electrical lead is run to the actuator, the borehole being sealed with respect to the fuel. Thus, the seal of the electrical lead with respect to the fuel is integrated into the gasket sheet, making an additional seal unnecessary and thus resulting in a more compact design.

The borehole is sealed with respect to the fuel by a peripheral weld, resulting in a simple, load-bearing and low-cost seal of the electrical lead with respect to the fuel.

The seal has a pot-shaped, elastically deformable actuator housing which is connected to the gasket sheet so that the actuator is hermetically enclosed by the actuator housing and the gasket sheet. This allows the actuator to be installed in the seal in a particularly easy manner, even possibly prior to being installed in the fuel injector, which can make it easier to test the seal for tightness.

The gasket sheet is connected to the actuator housing by a permanent joint, for example by a weld, providing a load-bearing, low-cost and no-wear seal, which retains its integrity for the duration of operation.

The pot-shaped, elastically deformable actuator housing has an elastically elongatable area, having an undulated design in the axial direction, which radially encloses the actuator, allowing a large actuator stroke in the actuator housing.

The pot-shaped elastically deformable actuator housing forms a pressure-tight chamber with the gasket sheet, relieving the fuel pressure on the actuator.

The actuator acts upon the valve needle via the pot-shaped, elastically deformable actuator housing, sealing the actuator with respect to leakage fuel that may occur in the area of the moving valve needle.

BRIEF DESCRIPTION OF THE DRAWINGS

Some embodiments of the present invention are illustrated in a simplified manner in the drawing and explained in detail in the description that follows.

DETAILED DESCRIPTION

Figure 1:
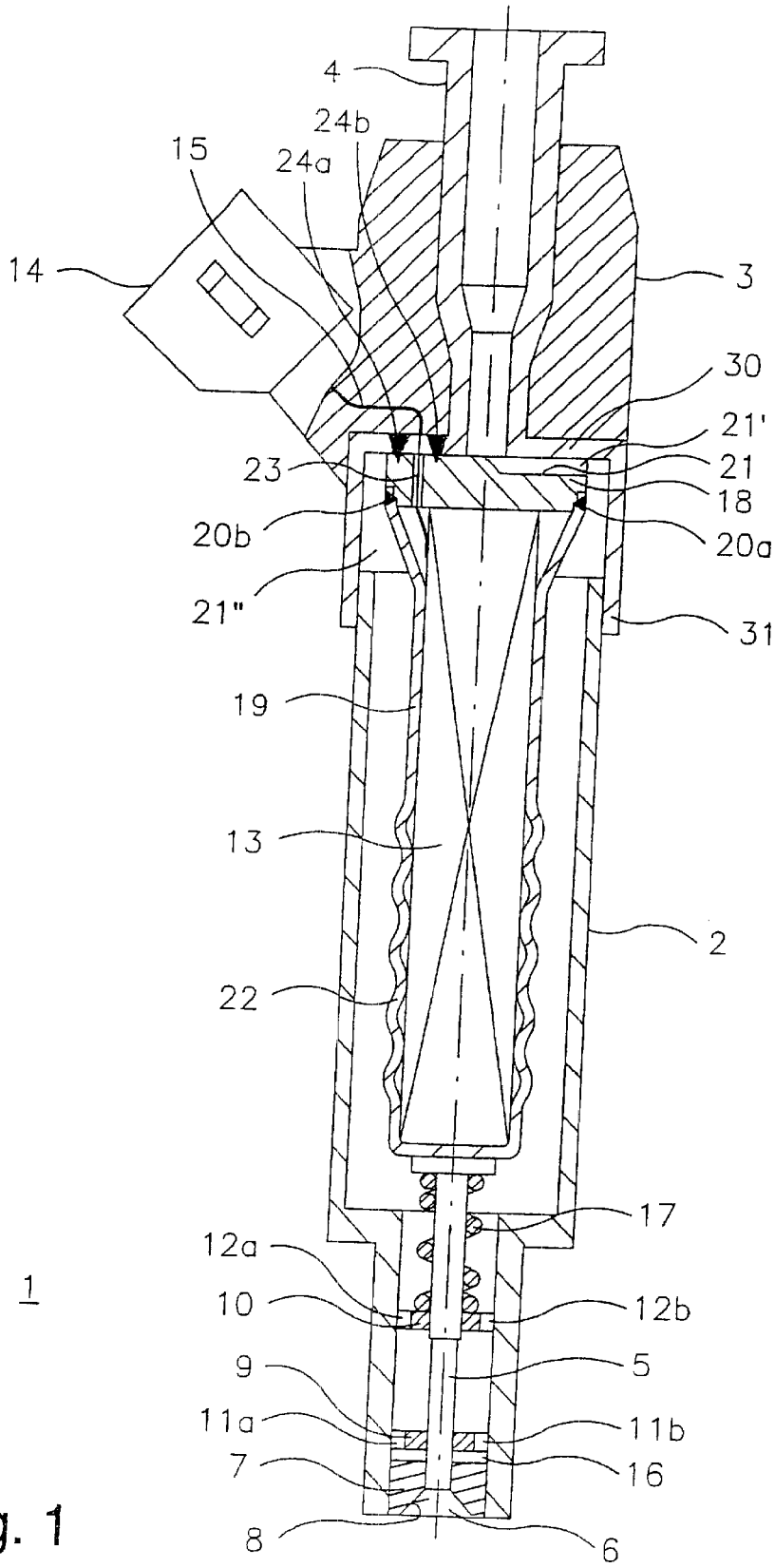
FIG. 1 shows a partial axial section through an embodiment of a fuel injector according to the present invention having an actuator, which is sealed with respect to the fuel by a seal, the other components of the fuel injector being only schematically illustrated.

FIG. 1 shows in a partial axial section a fuel injector 1 according to the present invention. Fuel injector 1 can be used, in particular, for direct injection of fuel, for example, of gasoline, into a combustion chamber of a compressed mixture, externally ignited internal combustion engine, for example as a "direct gasoline injector." Fuel injector 1 according to the present invention is also suited for other applications.

Fuel injector 1 has a front valve housing 2, a back valve housing 3, and a fuel inlet connection piece 4, which together form the housing of fuel injector 1. A valve closing body 6 which in the embodiment illustrated is designed in one piece with a valve needle 5 and which can be actuated by valve needle 5 is located in front valve housing 2. Valve closing body 6 has a truncated cone shaped tapering in the direction of injection. Valve closing body 6 works together with a valve seat surface 8 formed on a valve seat body 7 to form a seal seat. Valve needle 5 is guided in its axial movement by valve needle guides 9, 10 which are attached to front valve housing 2. In order to allow fuel to flow through, valve needle guides 9, 10 have cutouts 11*a*, 11*b*, 12*a*, 12*b*.

An actuator 13, which has a piezoelectric or magnetostrictive design, is used to actuate fuel injector 1. Actuator 13 is actuated by an electrical control signal, which is transmitted to actuator 13 via a terminal 14 and an electrical lead 15. When actuator 13 is actuated, it expands and acts upon valve needle 5, whereby valve closing body 6 is lifted from valve seat surface 8 of valve seat body 7, exposing the seal seat.

Due to the gap formed between valve closing body 6 and valve seat body 7, fuel exits from a fuel chamber 16 of fuel injector 1 into a combustion chamber, not illustrated, of the internal combustion engine. Valve needle 5 is reset via a compression spring 17, supported on one side by valve needle guide 10 and on the other side by valve needle 5.

Fuel is supplied via fuel inlet connection piece 4, which is embedded in rear valve housing 3, designed as an injectionmolded plastic part, for example, and has electrical terminal 14 for electrical lead 15.

A seal 18, 19, having a gasket sheet 18 and a pot-shaped, elastically deformable actuator housing 19, is used for sealing actuator 13 with respect to the fuel. Actuator housing 19 is permanently connected to gasket sheet 18 by a weld 20*a*, 20*b*, sealing actuator 13 completely by seal 18, 19 with respect to the fuel. In order to guide the fuel from fuel inlet connection piece 4 toward the seal seat formed by valve closing body 6 and valve seat surface 8, gasket sheet 18 has at least one recessed cutout 21. The at least one cutout 21 of gasket sheet 18 is covered by a radial section 30 of fuel inlet connection piece 4, in contact with the end face of gasket sheet 18 facing away from the seal seat, forming at least one fuel channel 21'. The fuel flows in this fuel channel 21' largely in the radial direction, the fuel can flow being deflected at the outer periphery of gasket sheet 18 in an axial direction. Another annular fuel channel 21" which continues in front valve housing 2 between the housing wall and actuator housing 19 can be formed between a sleeve-shaped axial section 31 of fuel inlet connection piece 4 and actuator housing 19. Actuator housing 19 has an undulated elastically elongatable area 22 also in order to allow large strokes of actuator 13. Gasket sheet 18 has a borehole 23 for the passage of electrical lead 15 from terminal 14 to actuator 13, and is sealed with respect to the fuel with a peripheral weld designated in the drawing by 24*a*, 24*b*, which permanently connects gasket sheet 18 to fuel inlet connection piece 4.

Pot-shaped elastically deformable actuator housing 19 may have a tubular pressure sleeve, preferably made of metal, which radially encloses actuator 13, so that pot-shaped, elastically deformable actuator housing 19 forms a pressure chamber with gasket sheet 18 in order to seal actuator 13 with respect to the fuel.

Fuel injector 1 can also be designed as an inward-opening fuel injector 1, in which case the stroke of actuator 13 is reversed.

Figure 2:
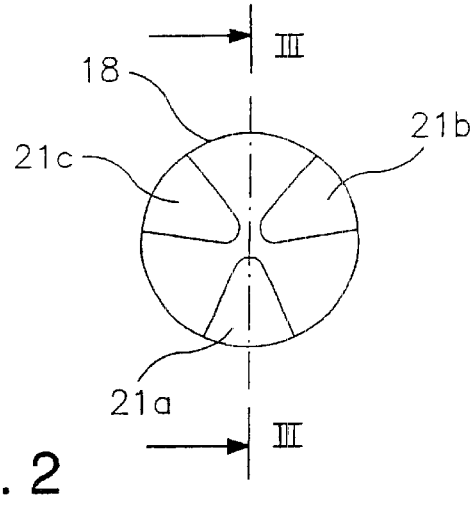
FIG. 2 shows a front view of a gasket sheet according to the embodiment illustrated in FIG. 1, having recessed radial flow-through segments.

FIG. 2 shows a gasket sheet 18 according to the present invention corresponding to a first exemplary embodiment. Gasket sheet 18 has three radially widening cutouts 21*a*–21*c*, through which the fuel is conducted from fuel inlet connection piece 4 toward the seal seat. Cutouts 21*a*–21*c* are arranged at a 120° offset, for example.

Figure 3:
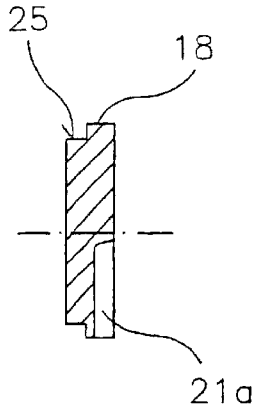
FIG. 3 shows a section along line III—III according to FIG. 2.

FIG. 3 shows a sectioned view of gasket sheet 18 illustrated in FIG. 2, showing cutout 21*a* in a sectional view. Gasket sheet 18 has a radial connecting surface 25, to which gasket sheet 18 can be permanently connected, for example, to pot-shaped, elastically deformable actuator housing 19 described in FIG. 1, for example, via a weld.

Figure 4:
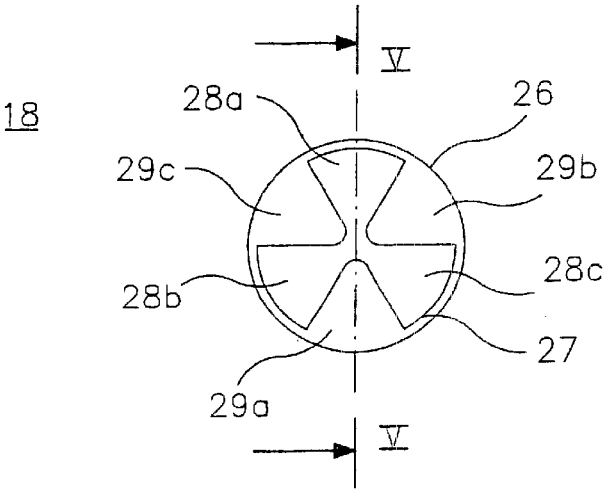
FIG. 4 shows a front view of a gasket sheet according to an alternative embodiment.

FIG. 4 shows, as an alternative embodiment of the present invention, a two-part design of gasket sheet 18, having a baseplate 26 and a spacer 27. Spacer 27 has spacer elements 28*a*–28*c*, which are separated from one another by radially widening recesses 29*a*–29*c*. Spacer elements 28*a*–28*c* are, however, connected to one another in a central section of spacer 27. Due to recesses 29*a*–29*c*, the fuel is conducted from fuel inlet connection piece 4 toward the seal seat.

Figure 5:
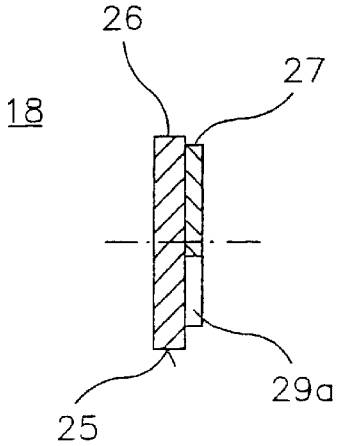
FIG. 5 shows a section along line V—V according to FIG. 4.

FIG. 5 shows a section along line V-V in FIG. 4. Connecting surface 25 of baseplate 26 is formed in this embodiment by the jacket surface of cylindrical baseplate 26.

Figure 6:
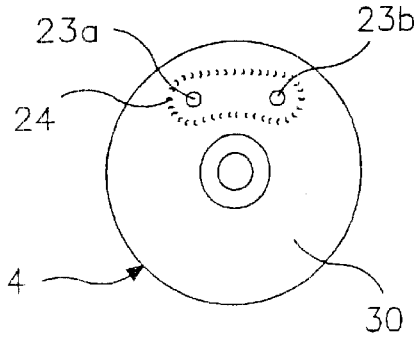
FIG. 6 shows a simplified top view of a radial section of the fuel inlet connection piece of the fuel injector according to FIG. 1.

FIG. 6 shows a simplified top view of radial section 30 of fuel inlet connection piece 4 of fuel injector 1 according to FIG. 1. Elements previously described are provided with the same reference symbols, making a repeat description unnecessary. Gasket sheet 18 has boreholes 23*a*, 23*b*, through which electrical lead 15 can be run to actuator 13. Boreholes 23*a*, 23*b* are sealed with respect to the fuel by peripheral weld 24, joining gasket sheet 18 to radial section 30 of fuel inlet connection piece 4, for example.

The present invention is not restricted to the embodiments described. In particular, a different number of fuel channels 21', a different design of cutouts 21*a*–21*c*, a different design of gasket sheet 18, connecting surface 25 and the number and shape of boreholes 23*a*, 23*b* is conceivable.

What is claimed is:

1. A fuel injector for a fuel injection system of an internal combustion engine, comprising:

a fuel inlet connection piece for supplying fuel;

an actuator, the actuator being one of a piezoelectric actuator and a magnetostrictive actuator;

a valve closing body actuatable by the actuator via a valve needle, the valve closing body cooperating with a valve seat surface to form a valve seat;

a seal, the actuator being sealed off from the fuel by the seal, the seal including a gasket sheet, the gasket sheet being arranged between the fuel inlet connection piece and the actuator, the seal further including at least one fuel channel for directing the fuel from the fuel inlet connection piece toward the valve seat.

2. The fuel injector according to claim 1, wherein the seal plate has a circular design.

3. A fuel injector for a fuel injection system of an internal combustion engine, comprising:

a fuel inlet connection piece for supplying fuel;

an actuator, the actuator being one of a piezoelectric actuator and a magnetostrictive actuator;

a valve closing body actuatable by the actuator via a valve needle, the valve closing body cooperating with a valve seat surface to form a valve seat;

a seal, the actuator being sealed off from the fuel by the seal, the seal including a gasket sheet, the gasket sheet being arranged between the fuel inlet connection piece and the actuator, the seal further including at least one fuel channel for directing the fuel from the fuel inlet connection piece toward the valve seat, wherein the gasket sheet has at least one recessed radial flow-through segment formed by one of a cutout and a recess.

4. A fuel injector for a fuel injection system of an internal combustion engine, comprising:

a fuel inlet connection piece for supplying fuel;

an actuator, the actuator being one of a piezoelectric actuator and a magnetostrictive actuator;

a valve closing body actuatable by the actuator via a valve needle, the valve closing body cooperating with a valve seat surface to form a valve seat;

a seal, the actuator being sealed off from the fuel by the seal, the seal including a gasket sheet, the gasket sheet being arranged between the fuel inlet connection piece and the actuator, the seal further including at least one fuel channel for directing the fuel from the fuel inlet connection piece toward the valve seat, wherein the gasket sheet has a baseplate and a spacer which contacts the baseplate, the baseplate having a cylindrical design and the spacer having at least one radial recess, the at least one fuel channel being formed by the at least one radial recess.

5. A fuel injector for a fuel injection system of an internal combustion engine, comprising:

a fuel inlet connection piece for supplying fuel;

an actuator, the actuator being one of a piezoelectric actuator and a magnetostrictive actuator;

a valve closing body actuatable by the actuator via a valve needle, the valve closing body cooperating with a valve seat surface to form a valve seat;

a seal, the actuator being sealed off from the fuel by the seal, the seal including a gasket sheet, the gasket sheet being arranged between the fuel inlet connection piece and the actuator, the seal further including at least one fuel channel for directing the fuel from the fuel inlet connection piece toward the valve seat, wherein the gasket sheet has at least one borehole through which at least one electrical lead is run to the actuator, the borehole being sealed with respect to the fuel.

6. The fuel injector according to claim 5, wherein the at least one borehole is sealed with respect to the fuel by a peripheral weld.

7. A fuel injector for a fuel injection system of an internal combustion engine, comprising:

a fuel inlet connection piece for supplying fuel;

an actuator, the actuator being one of a piezoelectric actuator and a magnetostrictive actuator;

a valve closing body actuatable by the actuator via a valve needle, the valve closing body cooperating with a valve seat surface to form a valve seat;

a seal, the actuator being sealed off from the fuel by the seal, the seal including a gasket sheet, the gasket sheet being arranged between the fuel inlet connection piece and the actuator, the seal further including at least one fuel channel for directing the fuel from the fuel inlet connection piece toward the valve seat, wherein the seal includes a pot-shaped, elastically deformable actuator housing which is connected to the gasket sheet so that the actuator is hermetically enclosed by the actuator housing and the gasket sheet.

8. The fuel injector according to claim 7, wherein the gasket sheet is connected to the actuator housing by at least one permanent joint and a weld.

9. The fuel injector according to claim 7, wherein the pot-shaped, elastically deformable actuator housing has an elastically elongatable area, having an undulated design in a axial direction, which radially encloses the actuator.

10. The fuel injector according to claim 7, wherein the pot-shaped, elastically deformable actuator housing forms a pressure-tight chamber with the gasket sheet, which resists the operating pressure of the fuel.

11. The fuel injector according to claim 7, characterized in that the actuator acts upon the valve needle via the pot-shaped, elastically deformable actuator housing.

12. A fuel injector for a fuel injection system of an internal combustion engine, comprising:

a fuel inlet connection piece configured to supply fuel;

an actuator including one of a piezoelectric actuator and a magnetostrictive actuator;

a valve closing body actuatable by the actuator via a valve needle, the valve closing body configured to cooperate with a valve seat surface to form a valve seat;

a seal configured to seal off the actuator from the fuel and including a gasket sheet arranged between the fuel inlet connection piece and the actuator, the seal including at least one fuel channel configured to direct fuel from the fuel inlet connection piece toward the valve seat.

13. The fuel injector according to claim 12, wherein the gasket sheet is circular.

14. The fuel injector according to claim 12, wherein the gasket sheet includes at least one recessed radial flow-through segment formed by one of a cutout and a recess.

15. The fuel injector according to claim 12, wherein the gasket sheet includes a cylindrical baseplate and a spacer that contacts the baseplate, the spacer including at least one radial recess that forms the fuel channel.

16. The fuel injector according to claim 12, wherein the gasket sheet includes at least one borehole configured to receive at least one electrical lead connectable to the actuator, the borehole sealed with respect to the fuel.

17. The fuel injector according to claim 16, wherein the borehole is sealed with respect to the fuel by a peripheral weld.

18. The fuel injector according to claim 12, wherein the seal includes a pot-shaped, elastically deformable actuator housing connected to the gasket sheet, the actuator hermetically enclosed by the actuator housing and the gasket sheet.

19. The fuel injector according to claim 18, wherein the gasket sheet is connected to the actuator housing by one of a permanent joint and a weld.

20. The fuel injector according to claim 18, wherein the pot-shaped, elastically deformable actuator housing includes an elastically elongatable area having an undulated configuration in an axial direction that radially encloses the actuator.

21. The fuel injector according to claim 18, wherein the pot-shaped, elastically deformable actuator housing forms a pressure-tight chamber with the gasket sheet configured to resist operating pressure of the fuel.

22. The fuel injector according to claim 18, wherein the actuator is configured to act upon the valve needle via the pot-shaped, elastically deformable actuator housing.

* * * * *

UNITED STATES PATENT AND TRADEMARK OFFICE

CERTIFICATE OF CORRECTION

PATENT NO. : 6,467,460 B1
DATED : October 22, 2002
INVENTOR(S) : Hubert Stier

It is certified that error appears in the above-identified patent and that said Letters Patent is hereby corrected as shown below:

Title page, Item [54] and Column 1, line 1,
Change the title from "FUEL INJECTION VALVE" to -- FUEL INJECTOR --.

Column 1,
Line 16, change "invention, has" to -- invention has --.

Column 2,
Line 1, change "cutout, or recess" to -- cutout or recess, --.

Column 3,
Line 49, change "fuel flows" to -- fuel can flow --.

Signed and Sealed this

Twenty-first Day of October, 2003

JAMES E. ROGAN
*Director of the United States Patent and Trademark Office*